US008319766B2

(12) United States Patent
Gormish et al.

(10) Patent No.: US 8,319,766 B2
(45) Date of Patent: Nov. 27, 2012

(54) SPATIALLY MASKED UPDATE FOR ELECTRONIC PAPER DISPLAYS

(75) Inventors: Michael J. Gormish, Redwood City, CA (US); Guotong Feng, Mountain View, CA (US)

(73) Assignee: Ricoh Co., Ltd., Tokyo (JP)

( * ) Notice: Subject to any disclaimer, the term of this patent is extended or adjusted under 35 U.S.C. 154(b) by 820 days.

(21) Appl. No.: 12/059,085

(22) Filed: Mar. 31, 2008

(65) Prior Publication Data

US 2008/0309612 A1 Dec. 18, 2008

Related U.S. Application Data

(60) Provisional application No. 60/944,415, filed on Jun. 15, 2007.

(51) Int. Cl.
*G09G 5/00* (2006.01)

(52) U.S. Cl. ..... 345/208; 345/94; 345/107; 345/84; 345/204; 359/265; 359/296

(58) Field of Classification Search ..... 345/85, 345/86, 87, 88, 89, 94, 95, 97, 105, 106, 345/107, 204, 208, 214, 84; 359/265, 296
See application file for complete search history.

(56) References Cited

U.S. PATENT DOCUMENTS

| | | | | |
|---|---|---|---|---|
| 4,065,770 | A | 12/1977 | Berry | |
| 4,367,465 | A | 1/1983 | Mati et al. | |
| 4,930,875 | A | 6/1990 | Inoue et al. | |
| 5,029,257 | A | 7/1991 | Kim | |
| 5,122,791 | A | 6/1992 | Gibbons | |
| 5,509,085 | A | 4/1996 | Kakutani | |
| 5,605,406 | A | 2/1997 | Bowen | |
| 5,608,420 | A | 3/1997 | Okada | |
| 5,703,621 | A | 12/1997 | Martin et al. | |
| 5,754,156 | A | 5/1998 | Erhart et al. | |
| 5,815,134 | A * | 9/1998 | Nishi | 345/97 |

(Continued)

FOREIGN PATENT DOCUMENTS

CN 1519620 8/2004

(Continued)

OTHER PUBLICATIONS

Bresenham, J.E., *Algorithm for Computer Control of a Digital Plotter,* IBM Systems Journal, 1965, pp. 25-30, vol. 4, No. 1.

(Continued)

*Primary Examiner* — Lun-Yi Lao
*Assistant Examiner* — Tom Sheng
(74) *Attorney, Agent, or Firm* — Patent Law Works LLP

(57) ABSTRACT

Electronic Paper Displays can suffer from "ghosting" or previous images remaining partially visible after the display has updated to show a new image. A pseudo-random noise intermediate image is used to make the ghosting less visible to human observers. Further, other intermediate images can be used to convey visible information or to convey secret information, e.g. a watermark. A control signal for driving the bi-stable display from the current optical state to an intermediate state, then to a final optical state is also determined. In some embodiments, the intermediate state for each pixel is determined in a pseudo-random manner. The pseudo-random noise values are applied to the bi-stable display to remove noise and other artifacts from the end resulting images. The determined control signal is applied to the bi-stable display to drive the bi-stable to the intermediate state, then to the final optical state.

30 Claims, 7 Drawing Sheets

U.S. PATENT DOCUMENTS

| | | | | |
|---|---|---|---|---|
| 5,963,714 | A | 10/1999 | Bhattacharjya et al. | |
| 6,067,185 | A | 5/2000 | Albert et al. | |
| 6,147,671 | A | 11/2000 | Agarwal | |
| 6,191,771 | B1 | 2/2001 | Kondoh | |
| 6,243,063 | B1 | 6/2001 | Mayhew et al. | |
| 6,285,774 | B1 | 9/2001 | Schumann et al. | |
| 6,327,017 | B2 | 12/2001 | Barberi et al. | |
| 6,377,249 | B1 | 4/2002 | Mumford | |
| 6,504,524 | B1 | 1/2003 | Gates et al. | |
| 6,563,957 | B1 | 5/2003 | Li et al. | |
| 6,721,458 | B1 | 4/2004 | Ancin | |
| 6,738,039 | B2 | 5/2004 | Goden | |
| 6,791,716 | B1 | 9/2004 | Buhr et al. | |
| 6,804,191 | B2 | 10/2004 | Richardson | |
| 6,809,724 | B1 | 10/2004 | Shiraishi et al. | |
| 6,850,217 | B2 | 2/2005 | Huang et al. | |
| 6,864,875 | B2 | 3/2005 | Drzaic et al. | |
| 6,901,164 | B2 | 5/2005 | Sheffer | |
| 7,012,600 | B2 | 3/2006 | Zehner et al. | |
| 7,034,814 | B2 | 4/2006 | Gong et al. | |
| 7,075,502 | B1 | 7/2006 | Drzaic et al. | |
| 7,109,967 | B2 | 9/2006 | Hioki et al. | |
| 7,119,772 | B2 | 10/2006 | Amundson et al. | |
| 7,154,452 | B2 | 12/2006 | Nakamura et al. | |
| 7,200,242 | B2 * | 4/2007 | Murakami | 382/100 |
| 7,227,519 | B1 | 6/2007 | Kawase et al. | |
| 7,280,103 | B2 * | 10/2007 | Taoka et al. | 345/204 |
| 7,372,594 | B1 | 5/2008 | Kusakabe et al. | |
| 7,456,808 | B1 | 11/2008 | Wedding et al. | |
| 7,528,848 | B2 | 5/2009 | Xu et al. | |
| 7,528,882 | B2 | 5/2009 | Saori et al. | |
| 7,733,311 | B2 | 6/2010 | Amundson et al. | |
| 7,804,483 | B2 | 9/2010 | Zhou et al. | |
| 7,839,381 | B2 | 11/2010 | Zhou et al. | |
| 8,041,291 | B2 | 10/2011 | Hullot et al. | |
| 2002/0036616 | A1 | 3/2002 | Inoue | |
| 2002/0056805 | A1 | 5/2002 | Bos et al. | |
| 2003/0011579 | A1 | 1/2003 | Gong et al. | |
| 2003/0020701 | A1 | 1/2003 | Nakamura et al. | |
| 2003/0063575 | A1 | 4/2003 | Kinjo | |
| 2003/0095094 | A1 | 5/2003 | Goden | |
| 2003/0137521 | A1 | 7/2003 | Zehner et al. | |
| 2003/0227441 | A1 | 12/2003 | Hioki et al. | |
| 2004/0002023 | A1 | 1/2004 | Sowinski | |
| 2004/0028256 | A1 | 2/2004 | Murakami | |
| 2004/0165115 | A9 | 8/2004 | Daly | |
| 2005/0013501 | A1 | 1/2005 | Kang et al. | |
| 2005/0116924 | A1 | 6/2005 | Sauvante et al. | |
| 2005/0174591 | A1 | 8/2005 | Sowinski et al. | |
| 2005/0179642 | A1 | 8/2005 | Wilcox et al. | |
| 2005/0212747 | A1 | 9/2005 | Amundson | |
| 2005/0219184 | A1 | 10/2005 | Zehner et al. | |
| 2005/0248575 | A1 | 11/2005 | Chou et al. | |
| 2005/0280626 | A1 | 12/2005 | Amundson et al. | |
| 2005/0281334 | A1 | 12/2005 | Walker et al. | |
| 2006/0055713 | A1 | 3/2006 | Asao et al. | |
| 2006/0066503 | A1 | 3/2006 | Sampsell et al. | |
| 2006/0066595 | A1 | 3/2006 | Sampsell et al. | |
| 2006/0112382 | A1 | 5/2006 | Glass et al. | |
| 2006/0164405 | A1 | 7/2006 | Zhou | |
| 2006/0169980 | A1 | 8/2006 | Morita et al. | |
| 2006/0170648 | A1 | 8/2006 | Zhou et al. | |
| 2007/0002009 | A1 | 1/2007 | Pasch et al. | |
| 2007/0013627 | A1 | 1/2007 | Hsieh et al. | |
| 2007/0035510 | A1 | 2/2007 | Zhou | |
| 2007/0052667 | A1 | 3/2007 | Zhou et al. | |
| 2007/0057905 | A1 | 3/2007 | Johnson et al. | |
| 2007/0057906 | A1 | 3/2007 | Johnson et al. | |
| 2007/0075949 | A1 | 4/2007 | Lu et al. | |
| 2007/0085819 | A1 | 4/2007 | Zhou et al. | |
| 2007/0087756 | A1 | 4/2007 | Hoffberg | |
| 2007/0139399 | A1 | 6/2007 | Cook | |
| 2007/0140351 | A1 | 6/2007 | Ho | |
| 2007/0176912 | A1 | 8/2007 | Beames et al. | |
| 2007/0205978 | A1 | 9/2007 | Zhou et al. | |
| 2007/0206262 | A1 | 9/2007 | Zhou | |
| 2008/0068291 | A1 | 3/2008 | Yuan et al. | |
| 2008/0084600 | A1 | 4/2008 | Bita et al. | |
| 2008/0111778 | A1 * | 5/2008 | Shen et al. | 345/87 |
| 2008/0135412 | A1 | 6/2008 | Cortenraad et al. | |
| 2008/0143691 | A1 | 6/2008 | Cook | |
| 2008/0198098 | A1 | 8/2008 | Gelbman et al. | |
| 2008/0243344 | A1 | 10/2008 | Cassey et al. | |
| 2008/0291129 | A1 | 11/2008 | Harris et al. | |
| 2011/0285754 | A1 | 11/2011 | Harrington et al. | |

FOREIGN PATENT DOCUMENTS

| | | | |
|---|---|---|---|
| CN | 1577471 | | 2/2005 |
| CN | 1589462 | | 3/2005 |
| JP | 02-136915 | A | 5/1990 |
| JP | 2003-256134 | A | 9/2003 |
| JP | 2006-243364 | A | 9/2006 |
| JP | 2006243364 | | 9/2006 |
| JP | 2007-102042 | A | 4/2007 |
| JP | 2007-241405 | A | 9/2007 |
| TW | 200504442 | | 2/2005 |
| WO | WO 03/044765 | A2 | 5/2003 |
| WO | WO 2004/034366 | A1 | 4/2004 |
| WO | 2005006296 | | 1/2005 |
| WO | WO 2005/027087 | A1 | 3/2005 |
| WO | 2005055187 | | 6/2005 |
| WO | WO 2005/073949 | | 8/2005 |
| WO | WO 2005/078692 | A1 | 8/2005 |
| WO | WO 2005/086131 | A1 | 9/2005 |
| WO | 2005101362 | | 10/2005 |
| WO | WO 2005/093705 | A1 | 10/2005 |
| WO | WO 2005/096259 | A1 | 10/2005 |
| WO | WO 2005/101362 | A1 | 10/2005 |
| WO | WO 2006/013502 | A1 | 2/2006 |
| WO | 2006090315 | | 8/2006 |
| WO | WO 2007/099829 | A1 | 9/2007 |
| WO | WO 2007/135594 | | 11/2007 |

OTHER PUBLICATIONS

Zehner, R. et al., *Drive Waveforms for Active Matrix Electrophoretic Displays,* May 2003, pp. 842-845, vol. XXXIV, Book II.

Joseph M. Crowley et al., *Dipole moments of gyricon balls,* Electrostatics Fundamentals. Applications and Hazards, Selected Papers from the Fourth IEJ-ESA Joint Symposium on Electrostatics, Sep. 25-26, 2000, pp. 247-259, vol. 55, No. 3-4.

PCT International Search Report and Written Opinion, PCT/JP2008/061277, Aug. 19, 2008, 11 pages.

PCT International Search Report and Written Opinion, PCT/JP2008/061273, Sep. 16, 2008, 11 pages.

PCT International Search Report and Written Opinion, PCT/JP2008/061272, Sep. 30, 2008, 10 pages.

PCT International Search Report and Written Opinion, PCT/JP2008/061271, Sep. 30, 2008, 11 pages.

PCT International Search Report and Written Opinion, PCT/JP2008/061278, Oct. 7, 2008, 11 pages.

Whitesides et al., "10.2: Towards Video-rate Microencapsulated Dual-Particle Electrophoretic Displays", 2004 SID International Symposium, Seattle, WA, May 25-27, 2004; [SID International Symposium], San Jose, CA, SID, US, vol. XXXV, May 25, 2004, pp. 133-135.

Johnson et al., "56.1: Invited Paper: High Quality Images on Electronic Paper Displays", 2005 SID International Symposium, Boston, MA, May 24-27, 2005 [SID International Symposium], San Jose, CA, SID, US, vol. XXXVI, May 24, 2005, pp. 1666-1669.

Extended European Search Report, Application No. 08765766.4, Feb. 9, 2011, 6 pages.

Extended European Search Report, Application 08765765.6, Mar. 10, 2011, 10 pages.

Extended European Search Report, Application No. 08777421.2, Apr. 15, 2011, 9 pages.

U.S. Office Action, U.S. Appl. No. 12/059,091, Mar. 15, 2011, 17 pages.

U.S. Office Action, U.S. Appl. No. 12/059,118, Apr. 20, 2011, 28 pages.

United States Office Action, U.S. Appl. No. 12/059,091, Jul. 27, 2011, 24 pages.

United States Office Action, U.S. Appl. No. 12/059,441, Aug. 12, 2011, 12 pages.

Chinese Office Action, Chinese Patent Application No. 200880000556.3, Apr. 8, 2011, 9 pages.
U.S. Office Action, U.S. Appl. No. 12/059,441, Apr. 20, 2011, 11 pages.
U.S. Office Action, U.S. Appl. No. 12/059,399, May 2, 2011, 29 pages.
Extended European Search Report, European Patent Application No. EP08777423, Jun. 7, 2011, 12 pages.
Chinese Office Action, Chinese Application No. 200880000725.3, Jun. 29, 2011, 9 pages.
U.S. Office Action, U.S. Appl. No. 12/415,899, Nov. 8, 2011, 27 pages.
U.S. Office Action, U.S. Appl. No. 12/059,441, Dec. 2, 2011, 29 pages.
U.S. Office Action, U.S. Appl. No. 12/059,118, Jan. 11, 2012, 23 pages.
U.S. Office Action, U.S. Appl. No. 12/059,399, Jan. 20, 2012, 54 pages.
United States Office Action, U.S. Appl. No. 12/059,118, Sep. 14, 2011, 54 pages.
United States Office Action, U.S. Appl. No. 12/059,399, Sep. 15, 2011, 44 pages.
United States Office Action, U.S. Appl. No. 12/059,091, Oct. 19, 2011, 32 pages.
JP Office Action, JP Patent Application No. 097122474, Feb. 23, 2012, 10 pgs.
U.S. Office Action, U.S. Appl. No. 12/059,091, Mar. 1, 2012, 49 pages.
U.S. Office Action, U.S. Appl. No. 12/059,441, Mar. 29, 2012, 22 pages.
U.S. Office Action, U.S. Appl. No. 12/415,899, Mar. 29, 2012, 32 pages.
U.S. Notice of Allowance, U.S. Appl. No. 12/059,118, Apr. 9, 2012, 19 pages.
EPO Communication, EP Patent Application No. 08 765 765.6-2205, Apr. 25, 2012, 9 pages.
U.S. Office Action, U.S. Appl. No. 12/059,399, May 3, 2012, 43 pages.
Chinese Office Action, Chinese Application No. 200880000556.3, Aug. 1, 2011, 10 pages.
Japanese Office Action, Japanese Patent Application No. 2009-506841, Dec. 6, 2011, 2 pages.

* cited by examiner

SPATIALLY MASKED UPDATE FOR ELECTRONIC PAPER DISPLAYS

CROSS REFERENCE TO RELATED APPLICATIONS

This application claims the benefit of U.S. Provisional Patent Application No. 60/944,415, filed Jun. 15, 2007, entitled "Systems and Methods for Improving the Display Characteristics of Electronic Paper Displays," the contents of which are hereby incorporated by reference in its entirety.

BACKGROUND

1. Field of Art

The disclosure generally relates to the field of electronic paper displays. More particularly, the invention relates to reducing visual artifacts on bi-stable displays.

2. Description of the Related Art

Several technologies have been introduced recently that provide some of the properties of paper in a display that can be updated electronically. Some of the desirable properties of paper that this type of display tries to achieve include: flexibility, wide viewing angle, low cost, light weight, low power consumption, high resolution, high contrast and readability indoors and outdoors. Because these displays attempt to mimic the characteristics of paper, they are referred to as Electronic Paper Displays (EPDs) in this application. Other names for this type of display include: paper-like displays, zero power displays, e-paper and bi-stable displays.

A comparison of EPDs to Cathode Ray Tube (CRT) displays or Liquid Crystal Displays (LCDs) reveals that in general, EPDs require much less power and have higher spatial resolution, but have the disadvantages of slower update rates, less accurate gray level control, and lower color resolution. Many electronic paper displays are currently only grayscale devices. Color devices are becoming available often through the addition of a color filter, which tends to reduce the spatial resolution and the contrast.

Electronic Paper Displays are typically reflective rather than transmissive. Thus they are able to use ambient light rather than requiring a lighting source in the device. This allows EPDs to maintain an image without using power. They are sometimes referred to as "bi-stable" because black or white pixels can be displayed continuously, and power is only needed when changing from one state to another. However, many EPD devices are stable at multiple states and thus support multiple gray levels without power consumption.

The low power usage of EPDs makes them especially useful for mobile devices where battery power is at a premium. Electronic books are a common application for EPDs in part because the slow update rate is similar to the time required to turn a page, and therefore is acceptable to users. EPDs have similar characteristics to paper, which also makes electronic books a common application.

While electronic paper displays have many benefits there are two problems: (1) slow update speed (also called update latency); and (2) visibility of previously displayed images, called ghosting.

The first problem is that most EPD technologies require a relatively long time to update the image as compared with conventional CRT or LCD displays. A typical LCD takes approximately 5 milliseconds to change to the correct value, supporting frame rates of up to 200 frames per second (the achievable frame rate is typically limited by the ability of the display driver electronics to modify all the pixels in the display). In contrast, many electronic paper displays, e.g. the E-Ink displays, take on the order of 300-1000 milliseconds to change a pixel value from white to black. While this update time is certainly sufficient for the page turning needed by electronic books, it is problematic for interactive applications like pen tracking, user interfaces and the display of video.

One type of EPD called a microencapsulated electrophoretic (MEP) display moves hundreds of particles through a viscous fluid to update a single pixel. The viscous fluid limits the movement of the particles when no electric field is applied and gives the EPD its property of being able to retain an image without power. This fluid also restricts the particle movement when an electric field is applied and causes the display to be very slow to update compared to other types of displays.

When displaying a video or animation, each pixel should ideally be at the desired reflectance for the duration of the video frame, i.e. until the next requested reflectance is received. However, every display exhibits some latency between the request for a particular reflectance and the time when that reflectance is achieved. If a video is running at 10 frames per second and the time required to change a pixel is 10 milliseconds, the pixel will display the correct reflectance for 90 milliseconds and the effect will be as desired. If it takes 100 milliseconds to change the pixel, it will be time to change the pixel to another reflectance just as the pixel achieves the correct reflectance of the prior frame. Finally, if it takes 200 milliseconds for the pixel to change, the pixel will never have the correct reflectance except in the circumstance where the pixel was very near the correct reflectance already, i.e. slowly changing imagery.

The second problem of some EPDs is that an old image can persist even after the display is updated to show a new image. This effect is referred to as "ghosting" because a faint impression of the previous image is still visible. The ghosting effect can be particularly distracting with text images because text from a previous image may actually be readable in the current image. A human reader faced with "ghosting" artifacts has a natural tendency to try to decode meaning making displays with ghosting very difficult to read.

FIG. 1A illustrates a ghosting artifact displayed on a bi-stable display in accordance with prior art techniques for updating a bi-stable display. The original image 102 is a large letter 'X' rendered in black on a white background. The next desired image is a large letter 'O' in black on a white background. The right side of FIG. 1A shows the image 106 after a direct update to the final value has been made, but the 'X' is still partially visible and appears as a faint image in the final image. The prior art systems apply the voltages to move pixels from their current state to the desired state, however, each pixel is a mix of the desired state and the original state.

FIG. 1B illustrates a prior art technique for reducing the ghosting artifacts present from normal operation as shown and described above with reference to FIG. 1A. Here, display control signals are used that do not bring each pixel to the desired final value immediately. The original image 110 is a large letter 'X' rendered in black on a white background. First, all the pixels are moved toward the white state as shown by the second image 112, then all the pixels are moved toward the black state as shown in a third image 114, then all the pixels are again moved toward the white state as shown in the fourth image 116, and finally all the pixels are moved toward their values for the next desired image as shown in the resulting image 118. Here, the next desired image is a large letter 'O' in black on a white background. Because of all the intermediate steps this process takes much longer than the direct update. However, moving the pixels toward white and black states tends to remove some of the ghosting artifacts as can be seen by comparing the prior art output image 106 with the result image 118. The residual artifact "X" in FIG. 1B is less visible than the artifact shown in FIG. 1A, but is still present.

Setting pixels to white or black values helps to align the optical state because all pixels will tend to saturate at the same point regardless of the initial state. Some prior art ghost reduction methods drive the pixels with more power than should be required in theory to reach the black state or white state. The extra power insures that regardless of the previous state a fully saturated state is obtained. In some cases, long term frequent over-saturation of the pixels may lead to some change in the physical media, which may make it less controllable.

One of the reasons that the prior art ghosting reduction techniques are objectionable is that the artifacts in the current image are meaningful portions of a previous image. This is especially problematic when the content of both the desired and current image is text. In this case, letters or words from a previous image are especially noticeable in the blank areas of the current image. For a human reader, there is a natural tendency to try to read this ghosted text, and this interferes with the comprehension of the current image. Prior art ghosting reduction techniques attempt to reduce these artifacts by minimizing the difference between two pixels that are supposed to have the same value in the final image.

It would therefore be highly desirable to produce an electronic paper display that requires a relatively short time to update a displayed image and displays less "ghosting" artifacts when a new image is updated on the display screen.

SUMMARY

One embodiment of a system for updating an image on a bi-stable display includes a module for determining a final optical state, estimating a current optical state and determining a desired intermediate state on the bi-stable display. The system also includes a control module for generating a control signal for driving the bi-stable display from the current optical state to the intermediate state, then to the final optical state.

One embodiment of a method for updating a bi-stable display includes determining a final optical state and estimating a current optical state on the bi-stable display. The method also includes determining a desired intermediate state. In some embodiments, an intermediate value is chosen for each pixel in a pseudo-random way. The intermediate value is applied to the bi-stable display to remove noise and other artifacts from the end resulting images. A control signal for driving the bi-stable display from the current optical state toward the intermediate state then toward a final optical state is also determined. The determined control signal is applied to the bi-stable display to drive the bi-stable display toward the intermediate state then toward the final optical state. The final image is displayed on the bi-stable display.

The features and advantages described in the specification are not all inclusive and, in particular, many additional features and advantages will be apparent to one of ordinary skill in the art in view of the drawings, specification and claims. Moreover, it should be noted that the language used in the specification has been principally selected for readability and instructional purposes, and may not have been selected to delineate or circumscribe the disclosed subject matter.

BRIEF DESCRIPTION OF DRAWINGS

The disclosed embodiments have other advantages and features which will be more readily apparent from the detailed description, the appended claims and the accompanying figures (or drawings).

DETAILED DESCRIPTION

Figure 1A:
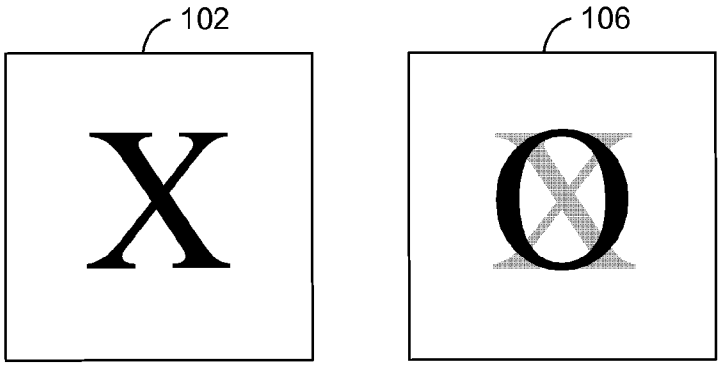
FIG. 1A Prior Art
FIG. 1A illustrates graphic representations of successive frames showing a ghosting artifact produced on a bi-stable display by prior art techniques for updating a bi-stable display.
Figure 1B:
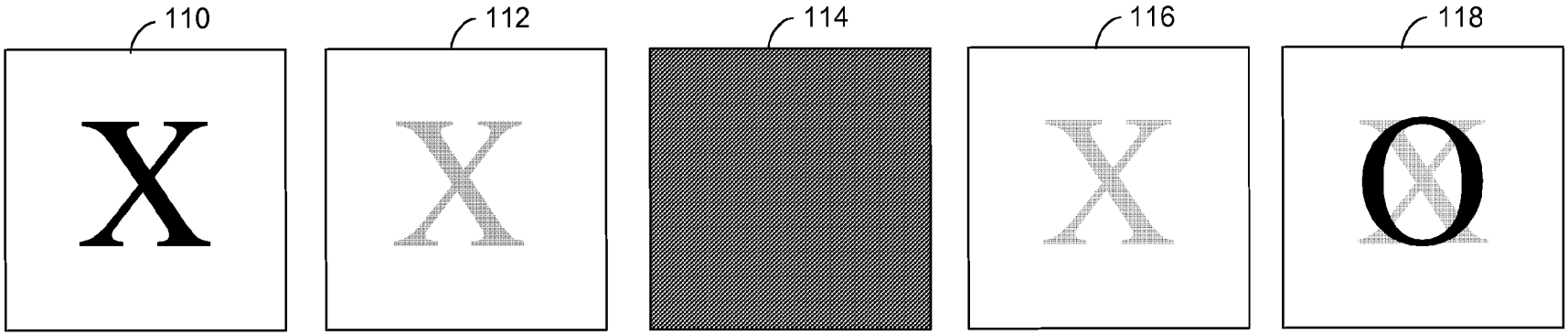
FIG. 1B Prior Art
FIG. 1B illustrates graphic representations of successive frames generated by a prior art technique for reducing the ghosting artifacts.

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

As used herein any reference to "one embodiment," "an embodiment," or "some embodiments" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article or apparatus that comprises a list of elements is not necessarily limited to only those elements but may include other elements not expressly listed or inherent to such process, method, article or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Figure 2:
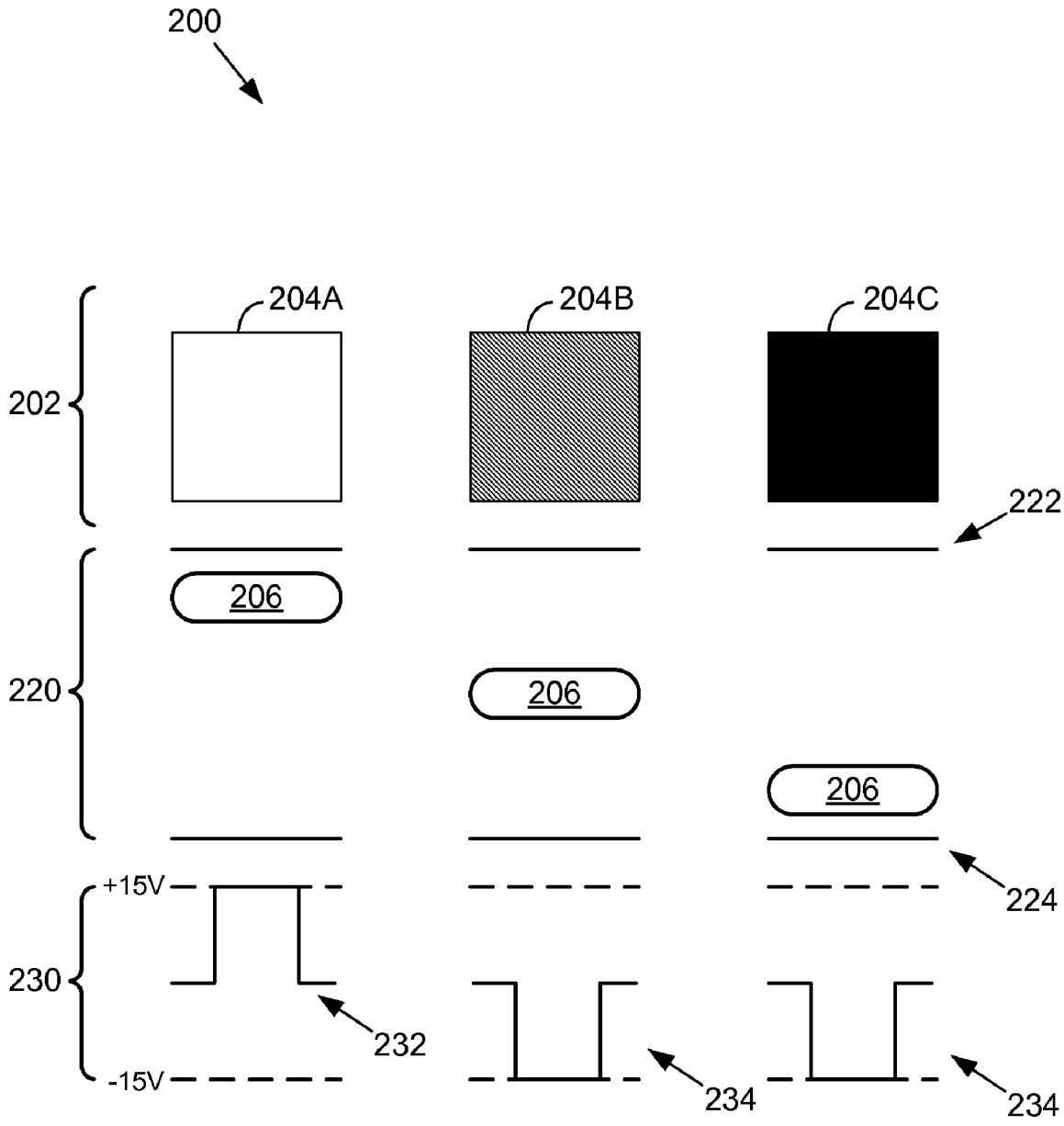
FIG. 2 illustrates a model of a typical electronic paper display in accordance with some embodiments.

FIG. 2 illustrates a model 200 of a typical electronic paper display in accordance with some embodiments. The model 200 shows three parts of an Electronic Paper Display: a reflectance image 202; a physical media 220 and a control signal 230. To the end user, the most important part is the reflectance image 202, which is the amount of light reflected at each pixel of the display. High reflectance leads to white pixels as shown on the left (204A), and low reflectance leads to black pixels as shown on the right (204C). Some Electronic Paper Displays are able to maintain intermediate values of reflectance leading to gray pixels, shown in the middle (204B).

Electronic Paper Displays have some physical media capable of maintaining a state. In the physical media 220 of electrophoretic displays, the state is the position of a particle or particles 206 in a fluid, e.g. a white particle in a dark liquid. In other embodiments that use other types of displays, the state might be determined by the relative position of two fluids, or by rotation of a particle or by the orientation of some structure. In FIG. 2, the state is represented by the position of the particle 206. If the particle 206 is near the top (222), white state, of the physical media 220 the reflectance is high, and the pixels are perceived as white. If the particle 206 is near the bottom (224), black state, of the physical media 220, the reflectance is low and the pixels are perceived as black.

Regardless of the exact device, for zero power consumption, it is necessary that this state can be maintained without any power. Thus, the control signal 230 as shown in FIG. 2 must be viewed as the signal that was applied in order for the physical media to reach the indicated position. Therefore, a control signal with a positive voltage 232 is applied to drive the physical media toward the top (222), white state, and a control signal with a negative voltage 234 is applied to drive the physical media toward the bottom (224), black state.

The reflectance of a pixel in an EPD changes as voltage is applied. The amount the pixel's reflectance changes may depend on both the amount of voltage the length of time for which it is applied, with zero voltage leaving the pixel's reflectance unchanged.

Method Overview

Figure 3:
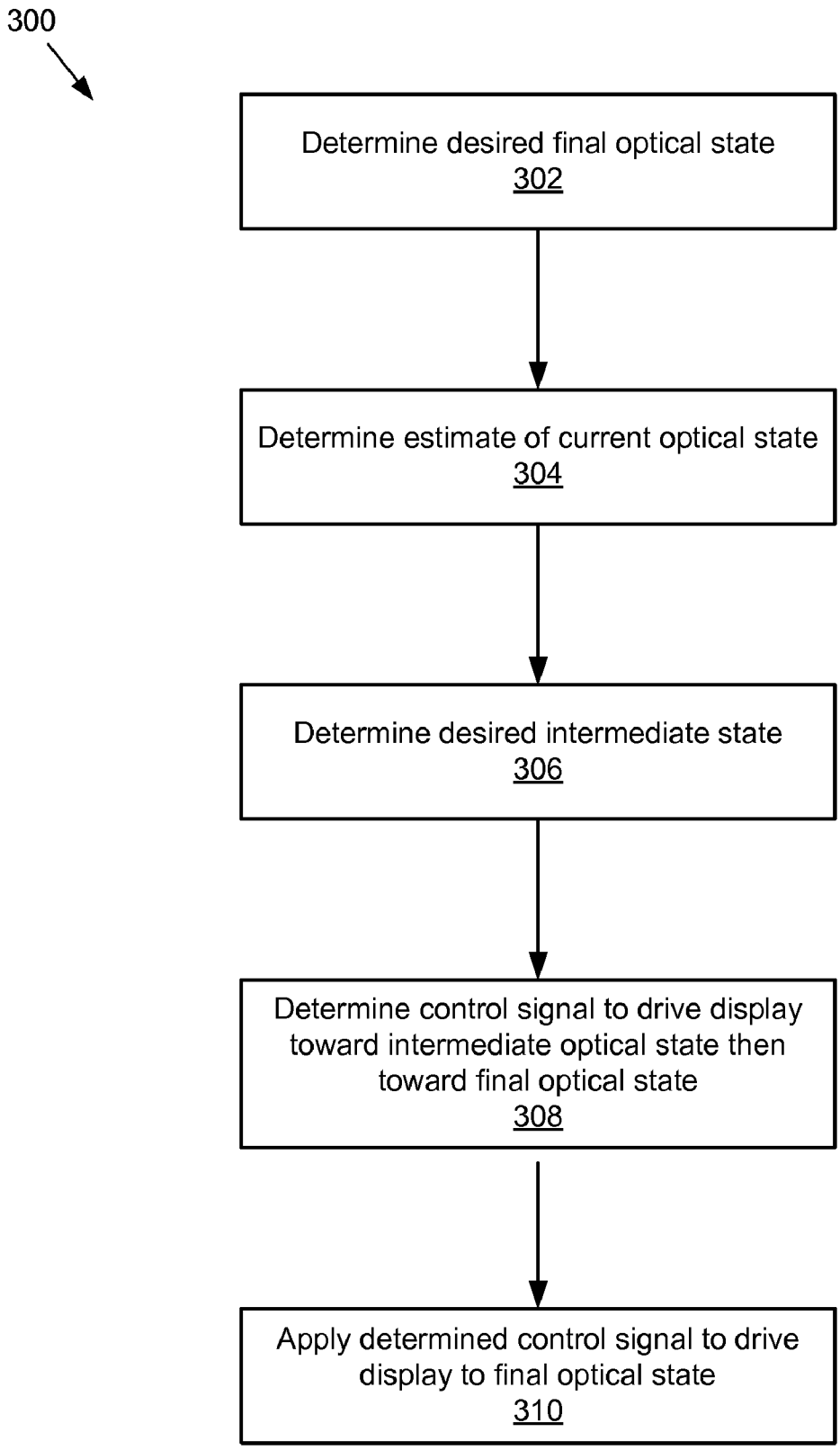
FIG. 3 illustrates a high level flow chart of a method for updating a bi-stable display in accordance with some embodiments.

FIG. 3 illustrates a high level flow chart of a method 300 for updating a bi-stable display in accordance with some embodiments. First, the desired final optical state is determined 302. In some embodiments, the desired optical state is an image received from an application consisting of a desired pixel value for every location of the display. In another embodiment, the desired optical state is an update to some region of the display. Next, an estimate of the current optical state is determined 304. In some embodiments, the current optical state is simply assumed to be the previously desired optical state. In other embodiments, the current optical state is determined from a sensor, or estimated from the previous control signals and some model of the physics of the display. Next, a desired intermediate state is determined, 306. There are several different methods that may be used to determine the desired intermediate state. In some embodiments, an intermediate state is chosen for each pixel in a pseudo random manner. In some embodiments, the intermediate optical state is different for some pixels that have the same current optical state and desired final optical state. In some other embodiments, the intermediate optical state is chosen to minimize artifacts in the perceived final image. In some embodiments, the intermediate reference optical state is chosen to induce a particular latent image. Once the estimated current state, desired intermediate state, and desired final optical state are known, the appropriate control signals can be determined 308 and applied 310. The determined control signal is applied 310 to the bi-stable display to drive the display toward the intermediate optical state then toward the final optical state. The final optical state is displayed on the bi-stable display. Visual artifacts and ghosting on the display is reduced and because there is only one intermediate state, the time needed to update the display from the current state to the final state is less compared to some prior art techniques, e.g. flashing the display to all black, all white, then all black.

Figure 4:
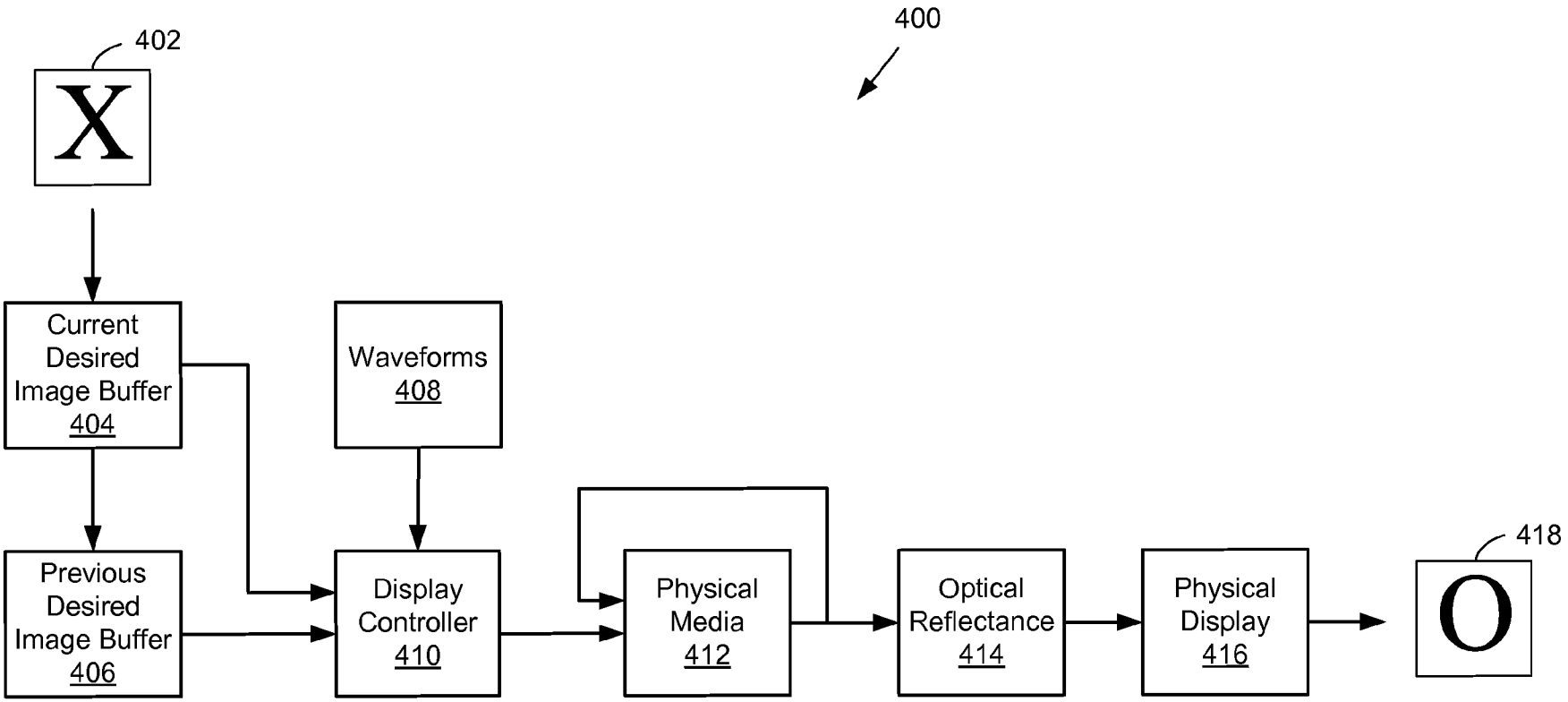
FIG. 4 illustrates a block diagram of an electronic paper display system in accordance with some embodiments.

FIG. 4 illustrates a block diagram of the operation of a system 400 for updating a bi-stable display in accordance with some embodiments. Data 402 associated with a desired image is provided into the system 400.

The desired image data 402 is sent and stored in current desired image buffer 404 which includes information associated with the current desired image. The previous desired image buffer 406 stores at least one previous image in order to determine how to change the display 416 to the new desired image. The previous desired image buffer 406 is coupled to receive the current image from the current desired image buffer 404 once the display 416 has been updated to show the current desired image. The waveform storage 408 is for storing a plurality of waveforms. A waveform is a sequence of values that indicate the control signal voltage that should be applied over time. The waveform storage 408 outputs a waveform responsive to a request from the display controller 410. There are a variety of different waveforms, each designed to transition the pixel from one state to another depending on the value of the previous pixel, the value of the current pixel, and the time allowed for transition. The waveform generated by waveform storage 408 is sent to a display controller 410 and converted to a control signal by the display controller 410. The display controller 410 applies the converted control signal to the physical media. The control signal is applied to the physical media 412 in order to move the particles to their appropriate states to achieve the desired image. The control signal generated by the display controller 410 is applied at the appropriate voltage and for the determined amount of time in order to drive the physical media 412 to a desired state.

For a traditional display like a CRT or LCD, the input image could be used to select the voltage to drive the display, and the same voltage would be applied continuously at each pixel until a new input image was provided. In the case of displays with state, however, the correct voltage to apply depends on the current state. For example, no voltage need be applied if the previous image is the same as the desired image. However, if the previous image is different than the desired image, a voltage needs to be applied based on the state of the current image, a desired state to achieve the desired image, and the amount of time to reach the desired state. For example, if the previous image is black and the desired image is white, a positive voltage may be applied for some length of time in order to achieve the white image, and if the previous image is white and the desired image is black, a negative voltage may be applied in order to achieve the desired black image. Thus, the display controller 410 in FIG. 4 uses the information in the current desired image buffer 404 and the previous image buffer 406 to select a waveform 408 to transition the pixel from current state to the desired state.

In some embodiments, the required waveforms used to achieve multiple states can be obtained by connecting the waveform used to go from the initial state to an intermediate state to the waveform used to go from the intermediate state to the final state. Because there will now be multiple waveforms for each transition, it may be useful to have hardware capable of storing more waveforms. In some embodiments, hardware capable of storing waveforms for any one of sixteen levels to any other one of sixteen gray levels requires 256 waveforms. If the imagery is limited to 4 levels, then only 16 waveforms are needed without using intermediate levels, and thus there could be 16 different waveforms stored for each transition.

According to some embodiments, it may require a long time to complete an update. Some of the waveforms used to reduce the ghosting problem are very long and even short waveforms may require 300 ms to update the display. Because it is necessary to keep track of the optical state of a pixel to know how to change it to the next desired image, some controllers do not allow the desired image to be changed during an update. Thus, if an application is attempting to change the display in response to human input, such as input from a pen, mouse, or other input device, once the first display update is started, the next update cannot begin for 300 ms. New input received immediately after a display update is started will not be seen for 300 ms, this is intolerable for many interactive applications, like drawing, or even scrolling a display.

With most current hardware there is no way to directly read the current reflectance values from the image reflectance 414; therefore, their values can be estimated using empirical data or a model of the physical media 412 of the display characteristics of image reflectance 414 and knowledge of previous voltages that have been applied. In other words, the update process for image reflectance 414 is an open-loop control system.

The control signal generated by the display controller 410 and the current state of the display stored in the previous image buffer 406 determine the next display state. The control signal is applied to the physical media 412 in order to move the particles to their appropriate states to achieve the desired image. The control signal generated by the display controller 410 is applied at the appropriate voltage and for the determined amount of time in order to drive the physical media 412 to a desired state. The display controller 410 determines pseudo-random noise values and applies those control signal values to move the physical media 412 to random values to produce an intermediate state. The intermediate state is displayed accordingly on the image reflectance 414 and visible by a human observer through the physical display 416.

In some embodiments, the environment the display is in, in particular the lighting, and how a human observer views the reflectance image 414 through the physical media 416 determine the final image 418. Usually, the display is intended for a human user and the human visual system plays a large role on the perceived image quality. Thus some artifacts that are only small differences between desired reflectance and actual reflectance can be more objectionable than some larger changes in the reflectance image that are less perceivable by a human. Some embodiments are designed to produce images that have large differences with the desired reflectance image, but better perceived images. Halftoned images are one such example.

Figure 5:
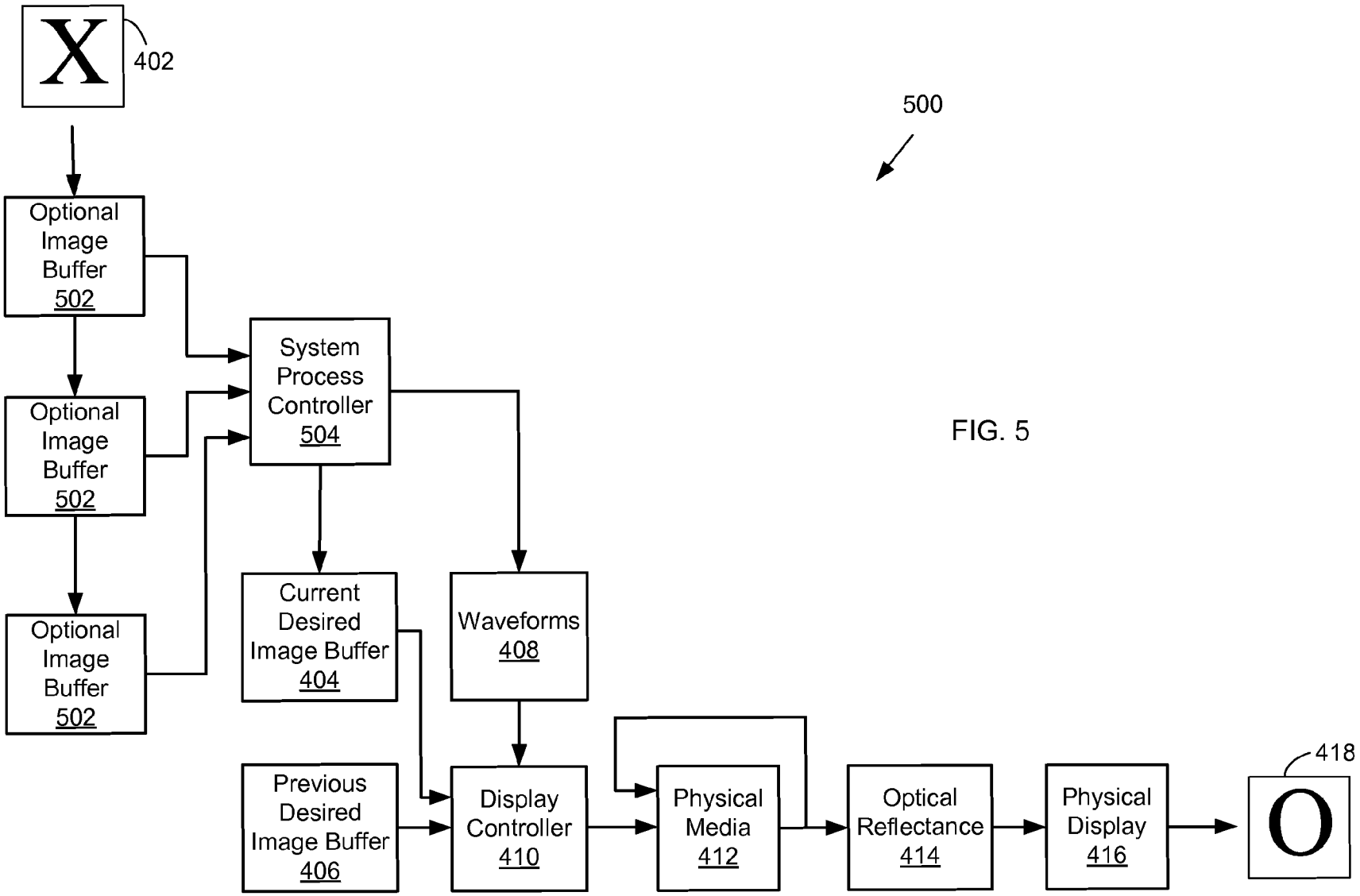
FIG. 5 illustrates a modified block diagram of an electronic paper display system with additional controls in accordance with some embodiments.

FIG. 5 illustrates a modified block diagram of an electronic paper display system 400 with additional controls in accordance with some embodiments. FIG. 5 includes all of the components of FIG. 4 plus a system process controller 504 and some optional image buffers 502. In some embodiments, the waveforms used in the base system from FIG. 4 are modified by the system process controller 504. In some embodiments, the desired image provided to the rest of the system 500 is modified by the optional image buffers 502 and system process controller 504 because of knowledge about the physical media 412, the image reflectance 414, and how a human observer would view the system. It is possible to integrate many of the embodiments described here into the display controller 410, however, in this embodiment, they are described separately operating outside of FIG. 4. The system process controller 504 and the optional image buffers 502 keep track of previous images, desired future images, and provide additional control that may not be possible in the current hardware. In the current application the buffers could be used to keep the desired intermediate image and desired final image, while the original system was manipulated to go through a particular intermediate state. For example in an application changing the display from an "X" image to and "O" image, the system 500, might keep those images in buffers 502, and generate the pseudo random image to be provided to the old system 400. Then once that image is completed, the system process controller 504 may change the waveforms and provide the old system with the desired final image. In some embodiments, the system includes a single optional image buffer. In other embodiments, the system includes multiple optional image buffers as shown in FIG. 5.

Illustrations of Artifact Reduction Techniques

In some embodiments, pixels are adjusted to different intermediate values before moving them to the final image as a means to eliminate objectionable artifacts. Technically, this method produces ghosting artifacts from a different image. In accordance with some embodiments, the appropriate intermediate image is chosen and the ghosting artifacts are much less objectionable than the previous image. This can be achieved by driving the pixels to an intermediate values, such that the intermediate values for the pixels are chosen in a pseudo-random manner. While evidence of this intermediate image may be present in the final image, the human visual system is less sensitive because it averages pixels that are spatially close.

This can be seen by comparing the images of prior art in FIG. 1A with the images produced by the present invention. With the prior art, the display initially contains the letter 'X' and the next image desired is the letter 'O'. Under a "direct update" operation, the black pixels in the 'X' that are not black in the 'O' image are adjusted to white, and the black pixels in the 'O' image that are not black in the 'X' image are adjusted to black. However, because the black pixels in the 'X' image did not start at the same state as the white background, they are still similar to each other and slightly different from the background in the final image.

Figure 6A:
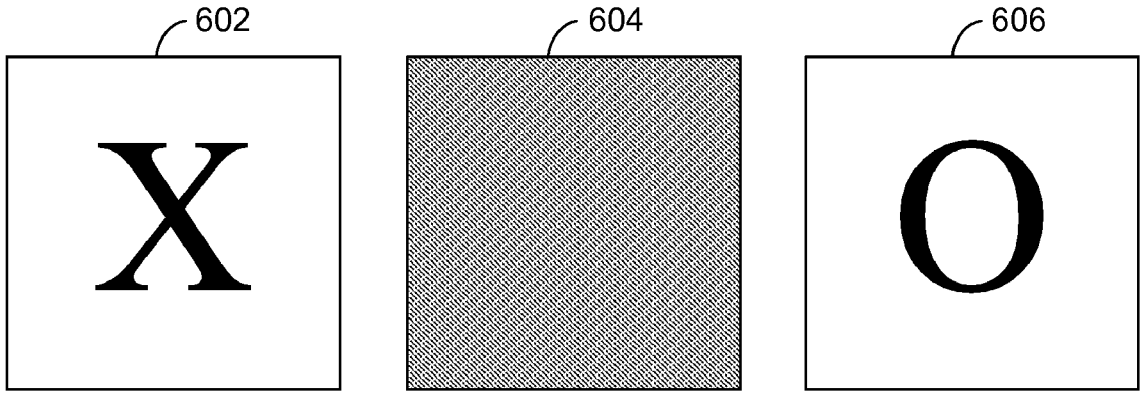
FIG. 6A illustrates graphic representations of successive frames applying an intermediate pseudo-random noise image during the update of a bi-stable display in accordance with some embodiments.

As shown in FIG. 6A, the original image 602 is a large letter 'X' rendered in black on a white background. Instead of adjusting the pixels directly from 'X' to 'O', the pixels are first sent to an intermediate state 604 by choosing pseudo-random values uniformly between black and white for each pixel. Note that in the image 604, a patterned image has been used rather than a pseudo random image, because pseudo random images do not reproduce well. Also in 604, a latent 'X' image is not visible, while on an actual display the previous image might be slightly visible. In FIG. 6A the 'X' image is still slightly visible at the intermediate state 604 because there is some correlation between all the pixels that came from the same value. However, when this image is adjusted to the final 'O' image 606 all of the pixels in the background have come from different initial conditions, so there is very little correlation. Close examination of the final 'O' image (606) on an EPD in this case reveals the pseudo noise pattern in background, but from a typical viewing distance the eye averages these values and the artifacts are unnoticeable.

Depending on the hardware and software available, this update to an intermediate noise image can be accomplished in a variety of ways. Any system that allows the developer to choose an image can use this technique to reduce visible ghosting by interspersing pseudo-random noise images between the desired images. Using an intermediate image without modification to the system 400 reduces the potential frame rate by a factor of two compared with a direct update solution.

In other hardware and software environments, it is possible to combine the intermediate image with the control signal. In this case, two nominally black pixels that are being updated to become white pixels will be sent different control signals. For example, one might be sent directly to white, and another might be sent to an intermediate value and then sent to white.

The choice of the pseudo-random image can also be different depending on the goals of the application or the display. Pseudo-random images with specially chosen frequencies may be used. In particular it can be best to choose the "noise image" such that the human visual system is not sensitive to the frequencies. For example, no low frequencies should be present. Intermediate images like the masks used in some forms of half toning may be useful, e.g. the "blue noise mask."

In some embodiments, the intermediate pseudo-random image is selected based on the content of the previous displayed image and the desired displayed image. For example the pseudo-random noise image could be filtered by the edges of the previous image. Thus the artifacts that would normally appear would be less visible because of the pseudo random noise, while constant color areas that would not show ghosting would be moved to a constant color intermediate image, therefore reducing the visibility of pseudo random noise in constant regions.

Figure 6B:
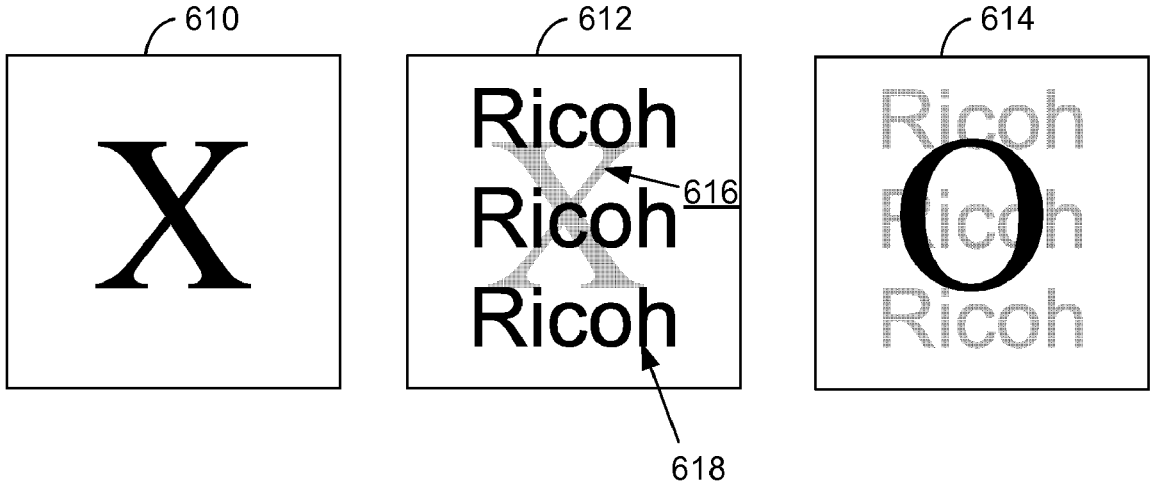
FIG. 6B illustrates graphic representations of successive frames applying a company name as an intermediate image during the update of a bi-stable display in accordance with some embodiments.

In some embodiments, as shown in FIG. 6B, an intermediate image 612 that does have some visible content is used, allowing for an explicit choice of the "ghost" image. In FIG. 6B, the original image 610 is a large letter 'X' rendered in black on a white background. In this embodiment, a company name 618 has been used as the intermediate image 612 to allow for advertising. In other embodiments, a graphical image may be chosen as the intermediate image 612.

As shown in FIG. 6B, "Ricoh Ricoh Ricoh" is used as the intermediate image 612. Alternatively, some sort of information might be stored in the ghosted image, e.g. information that allows the particular display device to be identified. This might be done in a visible manner e.g. by including numbers in text form, or in a hidden manner, like some sort of watermark. In this case, it might be necessary to scan the display and perform some computation to recover the information. For example, as seen in FIG. 6B, the company name 618 used as the intermediate image 612. As the intermediate image 612 is produced on the display, a visual artifact 616 of the original image 610 remains. A watermark of the company name 618 is visible in the final image 614, but the visual artifact 616 is no longer visible in the final image 614.

Figure 7:
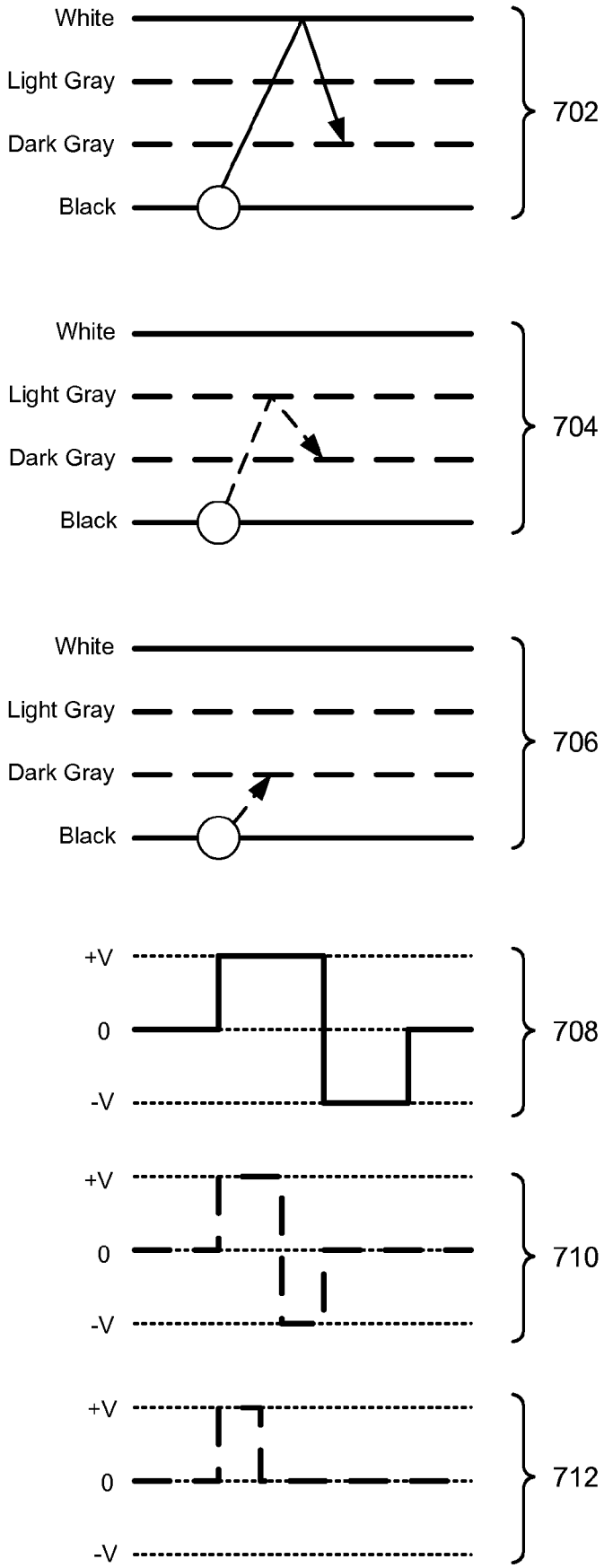
FIG. 7 illustrates a method for manipulating intermediate pixel states in accordance with some other embodiments.

FIG. 7 illustrates a method for selecting intermediate pixel states in accordance with some other embodiments. The storage of an intermediate image is not needed when there is a display controller 410 that generates the appropriate pseudo-random noise values. Instead of loading an intermediate image, the controller can generate a random destination value for each pixel and use the waveform that drives the pixel from its current state to that random destination value. The intermediate image would appear on the display device, and be stored in the previous image buffer. The waveforms required to go from the pseudo-randomly generated image to the final desired image would be used to cause the display to reach the final desired image state.

In an alternate embodiment, another means to achieve the adjustment of pixels to different intermediate values is to use different waveforms. Consider the case where three pixels are currently black and the desired image has all three pixels as dark gray. One of these pixels can be changed according to a first process 702 first to white, then to dark gray. The second pixel can be changed according to a second process 704 first to light gray, then to dark gray. The final pixel may be changed according to a third process 706 directly to dark gray. Images 708-712 show the waveforms of a control signal required to move each pixel toward the desired states. The waveform 708 is used to move the pixel in 702 from black to white to dark gray. The waveform 710 is used to move the pixel in 704 from black to light gray to dark gray. The waveform 712 is used to move the pixel in 706 from black to dark gray. A system can store waveforms corresponding to these different control signals (and similar control signals for other pixel transitions). Given the current image and the desired image, the controller can select different waveforms for pixels with the same initial state and desired final state.

Upon reading this disclosure, those of skill in the art will appreciate still additional alternative structural and functional designs for a system and a process for updating a bi-stable display through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A method for updating an image on a bi-stable display with a plurality of pixels, comprising:

determining a desired final optical state for the bi-stable display;

determining a current optical state for the bi-stable display;

determining a desired intermediate state for the bi-stable display including choosing an intermediate value for each pixel of the plurality of pixels in a pseudo-random manner;

determining a control signal voltage based at least on the current optical state for driving the bi-stable display from the current optical state toward the desired intermediate state, then toward the final optical state; and applying a determined control signal voltage to drive the bi-stable display from the current optical state toward the desired intermediate state, then toward the final optical state.

2. The method of claim 1, further comprising:
displaying the final optical state on the bi-stable display.

3. The method of claim 1, wherein applying the determined control signal voltage further includes:
combining the determined control signal voltage with the desired intermediate state.

4. The method of claim 1, further comprising:
determining, for at least some pixels of the plurality of pixels with a same current optical state and a same final optical state, different intermediate states.

5. The method of claim 1, further comprising:
determining, for two pixels of the plurality of pixels with a same current optical state and a same final optical state, different intermediate states.

6. The method of claim 1, wherein the intermediate optical state is chosen to minimize artifacts in the perceived final image.

7. The method of claim 1, wherein the intermediate optical state is chosen to induce a particular latent image.

8. The method of claim 7, wherein the particular latent image represents a word.

9. The method of claim 7, wherein the particular latent image represents a graphical image.

10. The method of claim 7, wherein the particular latent image appears as a watermark in the final optical state.

11. A system for updating an image on a bi-stable display with a plurality of pixels, comprising:
means for determining a desired final optical state for the bi-stable display;
means for determining a current optical state for the bi-stable display;
means for determining a desired intermediate state for the bi-stable display including choosing an intermediate value for each pixel of the plurality of pixels in a pseudo-random manner;
means for determining a control signal voltage based at least on the current optical state for driving the bi-stable display from the current optical state toward the desired intermediate state, then toward the final optical state; and
means for applying a determined control signal voltage to drive the bi-stable display from the current optical state toward the desired intermediate state, then toward the final optical state.

12. The system of claim 11, further comprising:
means for displaying the final optical state on the bi-stable display.

13. The system of claim 11, wherein means for applying the determined control signal voltage further includes:
means for combining the determined control signal voltage with the desired intermediate state.

14. The system of claim 11, further comprising:
means for determining, for at least some pixels of the plurality of pixels with a same current optical state and a same final optical state, different intermediate states.

15. The method of claim 11, further comprising:
determining, for two pixels of the plurality of pixels with a same current optical state and a same final optical state, different intermediate states.

16. The system of claim 11, wherein the intermediate optical state is chosen to minimize artifacts in the perceived final image.

17. The system of claim 11, wherein the intermediate optical state is chosen to induce a particular latent image.

18. The system of claim 17, wherein the particular latent image represents a word.

19. The system of claim 17, wherein the particular latent image represents a graphical image.

20. The system of claim 17, wherein the particular latent image appears as a watermark in the final optical state.

21. An apparatus for updating an image on a bi-stable display with a plurality of pixels, comprising:
a bi-stable display for displaying an optical state;
a module for determining a desired final optical state for the bi-stable display, for determining a current optical state for the bi-stable display, for determining a desired intermediate state for the bi-stable display including choosing an intermediate value for each pixel of the plurality of pixels in a pseudo-random manner, and for determining a control signal voltage based at least on the current optical state for driving the bi-stable display from the current optical state toward the desired intermediate state, then toward the final optical state; and
a controller for:
applying a determined control signal voltage to drive the bi-stable display from the current optical state toward the desired intermediate state, then toward the final optical state.

22. The apparatus of claim 21, further comprising:
a display for displaying the final optical state on the bi-stable display.

23. The apparatus of claim 21, wherein the controller for applying the determined control signal voltage combines the determined control signal voltage with the desired intermediate state.

24. The apparatus of claim 21,
wherein the module determines, for at least some pixels of the plurality of pixels with a same current optical state and a same final optical state, different intermediate states.

25. The apparatus of claim 21,
wherein the module determines, for two pixels of the plurality of pixels with a same current optical state and a same final optical state, different intermediate states.

26. The apparatus of claim 21, wherein the intermediate optical state is chosen to minimize artifacts in the perceived final image.

27. The apparatus of claim 21, wherein the intermediate optical state is chosen to induce a particular latent image.

28. The apparatus of claim 27, wherein the particular latent image represents a word.

29. The apparatus of claim 27, wherein the particular latent image represents a graphical image.

30. The apparatus of claim 27, wherein the particular latent image appears as a watermark in the final optical state.

* * * * *